United States Patent [19]

Schibbye et al.

[11] 4,084,405

[45] Apr. 18, 1978

[54] REFRIGERATING SYSTEM

[75] Inventors: Hjalmar Schibbye, Saltsjobaden; Tord Hölmstrom, Saltsjo-Boo, both of Sweden

[73] Assignee: Svenska Rotor Maskiner Aktiebolag, Nacka, Sweden

[21] Appl. No.: 728,156

[22] Filed: Sep. 30, 1976

[30] Foreign Application Priority Data

Sep. 30, 1975 United Kingdom ..... 39986/75

[51] Int. Cl.[2] ..... F25B 41/00

[52] U.S. Cl. ..... 62/197; 62/197; 62/506

[58] Field of Search ..... 62/506, 190, 197, 218

[56] References Cited

U.S. PATENT DOCUMENTS 21,599 10/1940 Schwarz ..... 62/506

3,353,367 11/1967 Garland et al. ..... 62/218

3,913,346 10/1975 Moody et al. ..... 62/197

*Primary Examiner*—William E. Wayner

*Assistant Examiner*—Robert Charvat

*Attorney, Agent, or Firm*—Flynn & Frishauf

[57] ABSTRACT

A refrigerating system comprises a liquid refrigerant supply line connecting the outlet of a condensor with a throttle valve connected to the inlet of an evaporator, a first liquid refrigerant receiver tank intermittently disconnected from the supply line and connected to a special suction line for performing a liquid refrigerant precooling sequence by drawing vapor from the receiver tank during time periods when the refrigerating cycle is continuously maintained via an additional receiver tank connected between the condensor and the throttle valve.

11 Claims, 3 Drawing Figures

REFRIGERATING SYSTEM

This invention relates to a refrigerating system comprising an evaporator, a condenser, a compressor device, a throttle valve and means for subcooling or precooling the refrigerant liquid before it enters the throttle valve connected to the inlet of the evaporator, thereby increasing the cooling capacity and the COP (coefficient of performance) of the refrigerating system.

A refrigerating system of this type is known utilizing two-stage compression and two-stage throttling and is often called an Economizer System. The advantage of two-stage throttling is to be seen in the fact that the so-called flash-gas after the first throttling stage only requires a compression in one of the compressor stages, whereas in a system with one-stage throttling this flash-gas would have to be compressed in both compressor stages.

It is possible to obtain a further improved cooling capacity and COP in a similar system by utilizing a large number of throttling stages with flash-gas suction between each stage. This system is complicated, however, since it requires a large number of compression stages.

A new refrigerating system has been suggested recently (in Swedish patent application 7412825-7 and corresponding to U.S. Pat. No. 4,014,182), however, which in a simple way makes it possible to obtain the same efficiency as that of the above described multistage system. The suggested refrigerating system includes the same components as a conventional refrigerating system, viz. a condenser, a throttle valve, an evaporator and a compressor. In addition the suggested system is equipped with a receiver tank, an additional valve, an additional suction line including a valve, and a check valve connected in the regular suction line between the compressor inlet and the outlet of the evaporator, said receiver being connected between the regular throttle valve and the additional valve. The said additional valve is connected to the outlet of the condenser, and said additional suction line is connected to the top portion of the receiver with the valve of said additional suction line connected to the inlet of the compressor. In normal operation the additional suction line valve is closed and the check valve is open. The evaporator is fed with liquid refrigerant from the receiver and the flow of refrigerant is controlled by the regular throttle valve, for instance a thermostatic expansion valve. The amount of liquid in the receiver is controlled by the additional valve, which for instance is a float valve controlling the liquid level in the receiver. The liquid refrigerant is fed to the upper part of the receiver in such a way that violent motion of the liquid in the receiver is avoided.

The additional suction line valve in the above-described suggested system is controlled by a thermostat sensing the temperature of the liquid refrigerant at the bottom portion of the receiver. When this temperature exceeds a set-value somewhat higher than the evaporating temperature the additional suction line valve opens and the check valve closes so that a precooling sequence starts when the compressor draws vapor from the top of the receiver containing warm liquid which will start boiling and thereby be rapidly cooled down. The said thermostat will shut the additional suction line valve when the liquid temperature in the receiver is lowered to the set-value of the thermostat and then the system will return to the normal mode of operation, now with a supply of precooled refrigerant liquid in the receiver. In this connection it is to be noted that commonly used refrigerants have a very high coefficient of thermal expansion and a low thermal conductivity and consequently the warm refrigerant liquid fed to the top portion of the receiver will stay on the top of the precooled liquid, provided that convective currents in the liquid are suppressed.

A drawback of the suggested system is to be seen in that the evaporator is disconnected from the compressor inlet during the precooling periods.

SUMMARY OF THE INVENTION

The main object of the present invention is to avoid said drawback and to provide an improved refrigerating system having the evaporator permanently connected to the compressor inlet. In accordance with the present invention, to obtain this improved system a compressor device is utilized having two inlet channels, one connected to the regular suction line from the evaporator and one connected to the additional suction line from the receiver. Moreover, a further receiver tank is utilized permitting in coaction with the first receiver a continuous flow of precooled liquid refrigerant to the evaporator, as stated.

BRIEF DESCRIPTION OF THE DRAWINGS

Two embodiments of the invention will now be described by way of example with reference of the accompanying drawings, wherein.

DETAILED DESCRIPTION

Figure 1:
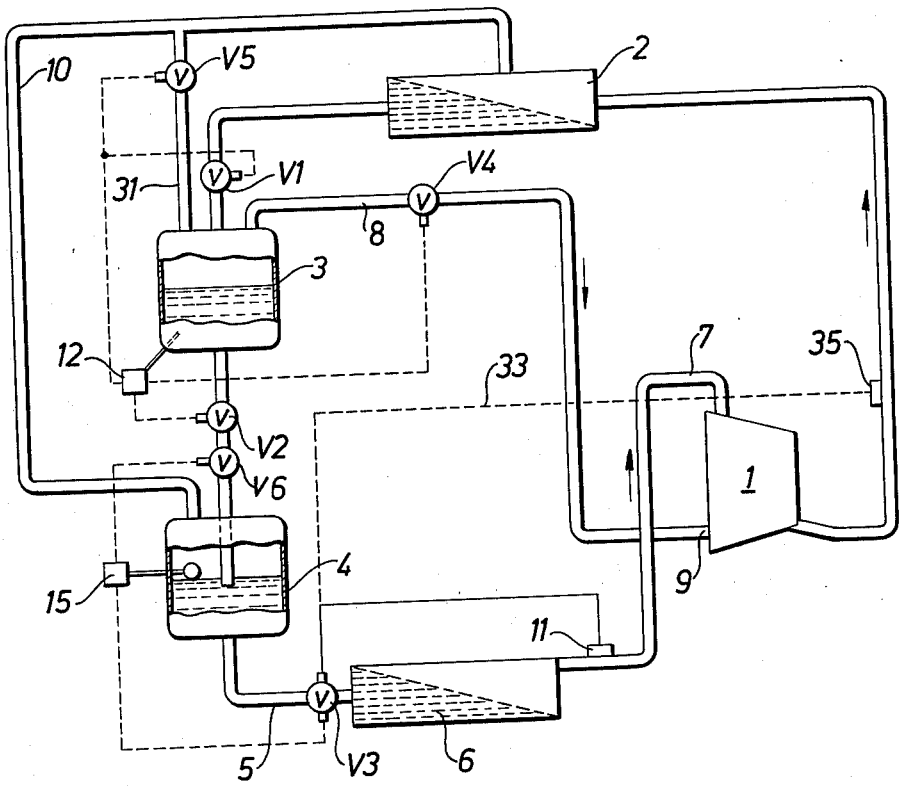
FIG. 1 is a block diagram embodying a preferred form of the invention.

The embodiment shown in FIG. 1 comprises a series connection of a suitable compressor device, for instance a screw compressor 1, a condenser 2, a valve V1, a first receiver tank 3, a valve V2 and a float valve V6 (which may be combined to a single valve controlled by two input signals), a second receiver tank 4, both receivers being of the conventional type discussed above, a throttle valve V3 contained in a supply line 5 to an evaporator 6, and a regular suction line 7 between the evaporator 6 and the inlet channel of the compressor 1. Each receiver 3 and 4 is partly filled with liquid refrigerant. The interior of the top portion of the receiver 3 communicates via an additional section line 8 and a valve V4 with a second inlet channel 9 of the screw compressor 1. The condenser pressure is supplied to the interior of the top portion of the second receiver 4 via an additional supply branch 10 and of the first receiver 3 via a further supply branch 31 containing a valve V5.

The throttle valve V3 is controlled in the usual way by a sensing device 11 sensing the outlet temperature and the pressure of the evaporator 6.

A temperature sensing device 12 is positioned in the bottom portion of the receiver 3 and arranged to close the valves V1, V2 and V5 and to open the valve V4 when warm liquid refrigerant appears in the bottom region of the receiver 3 during a normal refrigerating period when precooled liquid is supplied to evaporator 6 from receiver 4 and from receiver 3 to receiver 4.

After interruption of this refrigerating period the refrigerating cycle is maintained during a following period via receiver 4 supplied with condenser pressure via the additional supply branch 10, during which period precooling of the liquid in receiver 3 occurs, as previously described.

The precooling period is interrupted by the temperature sensing device 12 acting upon valves V1, V2, V4, V5 when the temperature in the receiver 3 has been reduced to a value equal to or just above that of the temperature in the evaporator.

Moreover, the level of the liquid in the receiver 4 is controlled by a level sensing control device 15 including the valve V6.

The condenser 2 is positioned above the receiver 3 and consequently liquid refrigerant can flow slowly down to the receiver 3 via the open valve V1. Opening and closing of the valve V6 is controlled by the level sensing control device 15. This valve V6 will keep a constant level in receiver 4 but will only be in operation when valve V2 is open and condenser pressure is supplied to said receiver 3. Consequently the amount of subcooled liquid refrigerant in receiver 4 must be sufficient to maintain the refrigeration cycle during the period when the refrigerant in receiver 3 is subcooled and valve V2 is closed. Thus, the level sensing device 15 controls an upper level of the liquid in the receiver 4 by opening and closing the valve V6. In order to prevent the receiver 4 from being emptied (if the valve V2 should be closed for a long time period) the level sensing device 15 is also arranged to close the valve V3 (as indicated by a dashed line between device 15 and valve V3) if the liquid level in receiver 4 should drop to a minimum level.

Figure 2:
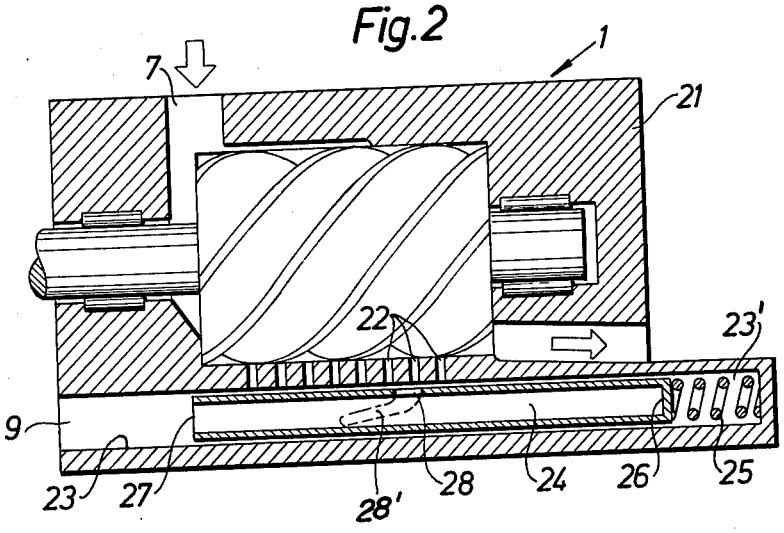
FIG. 2 is a fragment of a valve arrangement to be used in connection with a screw compressor.

The additional suction line 8 containing the valve V4 is connected to the inlet channel 9 communicating with a screw compressor thread having a suitable suction pressure. As shown in FIG. 2 the screw compressor housing 21 is suitably provided with a number of radial channels 22 communicating with different threads of the screw compressor. The channels 22 are connected to a bore 23 in which an elongated cap 24 is slidably journalled against the action of a spring 25 acting in a space 23' between a closed end 26 of said cap 24 and the housing 21. The inlet channel 9 of the compressor communicates with an open end 27 of the cap 24 and via a radial aperture 28 of the cap 24 with a certain channel 22, i.e., a certain thread of the screw compressor, dependent on the axial position of the cap 24, which in turn is dependent on the action of the spring 25 and the gas pressure in the additional suction line 8 from the receiver 3. Said radial aperture 28 has a width equal to the distance between the centre lines of said channel 22. Space 23' is in communication (not shown) with the compressor inlet and the pressure in said space is consequently equal to the inlet pressure.

In the embodiment of FIG. 1 the valve V1 is pressure operated and arranged to open when the pressure in the interior of the receiver 3 is equal to the condenser pressure. Thus, when a sufficiently low temperature of the liquid is indicated by the sensing device 12 valve V4 is closed and valve V5 is opened and after that valve V1 can open. As soon as the float valve control device 15 calls for supply of precooled refrigerant liquid the valve V6 will open.

In the refrigerating system according to the invention it is possible to use different types of compressor devices. Preferably, however, a screw compressor of the known type having two inlet channels is used, and in this case — since screw compressors are rather non-sensitive to liquid slugging — it is possible to work in the damp area giving rise to a further reduction of the compression losses. When working in the damp area, however, it is impossible to decide the actual position within the area by ordinary pressure or temperature indicators since the pressures and temperatures are constant within all the damp area. To solve this problem the expansion valve V3 of the refrigerating process should be controlled by the compressor outlet temperature instead of ordinarily by the evaporator outlet temperature. By letting the throttle valve V3 feel or respond to the condensing pressure and the outlet temperature of the compressor 1, as indicated by a control line 33 and a pressure and temperature sensing device 35 replacing the usual pressure and temperature sensing device 11 and its corresponding control line to the throttle valve V3 in FIG. 1, the throttle valve V3 can be caused to control the flow of refrigerant entering the evaporator so that there will be just enough liquid refrigerant left to obtain an outlet temperature somewhat above the condensing temperature, thereby also reducing or eliminating the need for separate oil cooling devices.

The present invention provides a continuous refrigerating cycle maintained by means of an additional receiver feeding the evaporator during the precooling periods of the first receiver. In the embodiment shown in FIG. 1 the two receivers are arranged in series between the outlet of the condenser 2 and the throttle valve V3. It is also possible, as an alternative, to have the receivers arranged in parallel, one of the receivers feeding the evaporator during the precooling periods of the other receiver, and vice versa.

Figure 3:
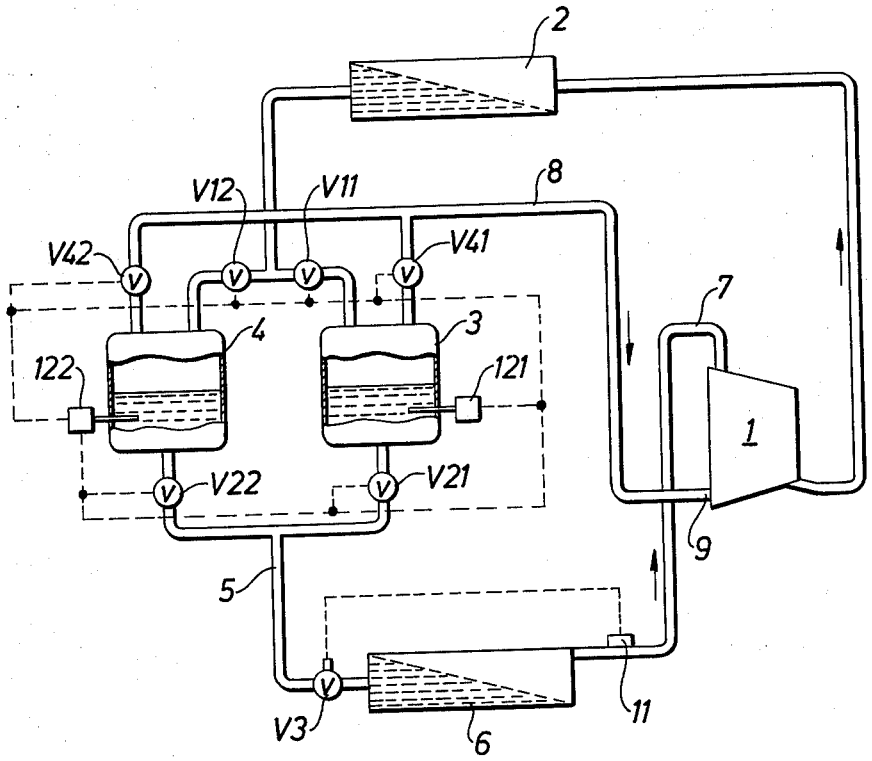
FIG. 3 is a block diagram embodying another form of the invention.

An embodiment of the invention comprising two receivers 3, 4 connected in parallel is shown in FIG. 3. This embodiment differs from that of FIG. 1 in that the supply branches 10 and 31 and the valve V5 are omitted and in that the receiver 4 is of the same type as receiver 3 and is connected to the condenser 2, the throttle valve V3 and the additional inlet channel 9 of the compressor 1 in the same way as receiver 3. Thus, the two receivers 3 and 4 are each connected via a respective valve V11, V12 to the condenser 2, via a respective valve V21, V22 to the throttle valve V3 and via a respective valve V41 and V42 to the additional inlet channel 9 of the compressor 1.

During each refrigerating cycle of the receiver 3 and precooling cycle of receiver 4 the valve V11, V21 and V42 are open and valves V12, V22 and V41 are closed until a temperature sensing device 121 in the bottom portion of receiver 3 indicates a temperature rise when warm liquid refrigerant appears in the bottom zone of receiver 3 and initiates said valves to switch over to their opposite positions in which the valves V11, V21 and V42 are closed and V12, V22 and V41 are open. Thus, the refrigerating cycle now is taken over by receiver 4 and the precooling cycle by receiver 3 until a temperature sensing device 122 in the bottom portion of the receiver 4 starts indicating a temperature rise when warm liquid refrigerant appears in the bottom zone of the receiver 4 and initiates said valves to switch back to their original positions in which the valves V12, V22 and V41 are closed and valves V11, V21 and V42 are open.

The invention is not restricted to the embodiments shown in the drawings but various changes and modifications can be made within the inventive concept. Thus, it is suitable for instance to use a screw compressor of the known type having a slide valve for capacity control. Moreover, the aperture 28 of the cap 24 and the axial compression spring 25 may be replaced by a sloping slot 28' and a flat spiral spring, respectively, the cap 24 being turnable to connect the slot in a manner known per se to the different channels 22 dependent on the angular position of the cap 24. It is also possible to combine a sliding and turning motion of the cap 24.

We claim:

1. A refrigerating system comprising:

an evaporator (6) having an inlet and an outlet;

a condenser (2) having an inlet and an outlet;

a compressor device (1), the output of which is coupled to said condenser inlet;

a supply line (5) coupled to said inlet of said evaporator (6);

a throttle valve (V3) located in said supply line (5) to said inlet of said evaporator (6);

a closed receiver tank (3) containing a liquid refrigerant and having an inlet and an outlet;

an inlet valve (V1; V11) coupling an inlet of said closed receiver tank (3) to said outlet of said condenser (2);

an outlet valve (V2; V21) coupling an outlet of said closed receiver tank (3) to said supply line (5) for said evaporator (6);

control means (12; 121) coupled to said closed receiver tank (3) for controlling the amount of liquid refrigerant in said closed receiver tank (3), said control means being further controllably coupled to said inlet and outlet valves for controlling the operation of said inlet and outlet valves;

said compressor device (1) including a first inlet channel (7) permanently communicating with said outlet of said evaporator (6), and an additional inlet channel (9);

means including an additional valve (V4; V41) coupling said additional inlet channel (9) of said compressor device (1) to the top of said closed receiver tank (3), said additional valve (V4; V41) being coupled to said control means (12; 121);

said control means (12; 121) controlling said valves (V1, V2, V4; V11, V21, V41) for intermittent disconnection of said closed receiver tank (3) from said condenser (2) and evaporator (6) and corresponding intermittent connection of the top of said closed receiver tank (3) to said additional inlet channel (9) for a time interval; and an additional receiver tank (4) containing a controlled amount of liquid refrigerant coupled to said condenser (2) and further coupled to said evaporator (6) for feeding said evaporator (6) under the influence of the condenser pressure supplied to said additional receiver tank (4), thereby maintaining the refrigerating cycle during said intermittent time interval.

2. A refrigerating system as defined in claim 1 comprising an additional supply branch (10) continuously coupling said condenser (2) to said additional receiver tank (4).

3. A refrigerating system as defined in claim 1 wherein said control means (12) is responsive to the liquid refrigerant temperature in said closed receiver tank (3) for controlling said valves to control the liquid refrigerant level in said closed receiver tank (3).

4. A refrigerating system as defined in claim 1 comprising means for supplying said additional receiver tank (4) with liquid refrigerant from said first closed receiver tank (3) when said inlet and outlet valves (V1, V2) of said control means (12) are open.

5. A refrigerating system as defined in claim 1 wherein said additional receiver tank (4) is coupled in said supply line (5) upstream of said throttle valve (V3), whereby said receiver tanks (3, 4) are coupled in series.

6. A refrigerating system as defined in claim 5 comprising a further valve (V6) coupled to the inlet of said additional receiver tank (4); and means (15) responsive to the liquid refrigerant level in said additional receiver tank (4) for opening and closing at least said further valve (V6) to control the liquid refrigerant level in said additional receiver tank (4).

7. A refrigerating system as defined in claim 1 wherein said additional receiver tank (4) is of the same type as said first closed receiver tank (3) and is connected in parallel with said first closed receiver tank (3) and comprising another additional valve (V42) coupled to the top of said additional receiver tank (4), said receiver tanks (3, 4) being connected to said condenser (2), to said evaporator (6) and to said additional inlet channel (9) of said compressor via said valves (V11, V21, V42; V12, V22, V41) which alternatingly connects one of said receiver tanks (3, 4, respectively) to said condenser (2) and to said evaporator (6), said valve means at the same time coupling the top of the other of said receiver tanks (4, 3, respectively) to said second inlet channel (9) via a respective additional valve (V41, V42), and vice versa.

8. A refrigerating system as defined in claim 1 wherein said compressor device is a screw compressor (1) having a thread with a suitable suction pressure, said additional inlet channel (9) being in communication with said thread.

9. A refrigerating system as defined in claim 8 wherein said screw compressor comprises a valve boring (23), a valve cap (24) movably mounted in said valve boring, and a number of radial compressor housing channels (22) connecting different thread portions of the screw compressor to said valve boring (23), whereby in each of said different positions of said valve cap in said valve boring a specific radial channel (22) is connected to said additional channel (9).

10. A refrigerating system as defined in claim 9 comprising spring means (25) coupled to said valve cap (24), said valve cap (24) being slidably movable in said valve bore (23) under the influence of the pressure in said additional channel (9) and against the action of said spring means (25).

11. A refrigerating system as defined in claim 9 comprising spring means (25) coupled to said valve cap (24), said valve cap being turnably and slidably movable in said valve bore (23) under the influence of the pressure in said additional inlet channel (9) and against the action of said spring means (25), said valve cap being provided with a sloping slot (28') connecting said additional inlet channel (9) with a specific radial channel (22) corresponding to a specific axial and angular position of the valve cap.

* * * * *